US011643251B2

(12) United States Patent
Rodriguez

(10) Patent No.: US 11,643,251 B2
(45) Date of Patent: May 9, 2023

(54) BEVERAGE SHADE

(71) Applicant: Jeffrey Joel Rodriguez, Corralitos, CA (US)

(72) Inventor: Jeffrey Joel Rodriguez, Corralitos, CA (US)

( * ) Notice: Subject to any disclaimer, the term of this patent is extended or adjusted under 35 U.S.C. 154(b) by 142 days.

(21) Appl. No.: 17/214,484

(22) Filed: Mar. 26, 2021

(65) Prior Publication Data

US 2022/0306342 A1 Sep. 29, 2022

(51) Int. Cl.

| | |
|---|---|
| ***B65D 37/00*** | (2006.01) |
| ***B65D 23/08*** | (2006.01) |
| ***A47G 23/02*** | (2006.01) |

(52) U.S. Cl.

CPC ..... *B65D 23/08* (2013.01); *A47G 23/0216* (2013.01); *A47G 2023/0291* (2013.01)

(58) Field of Classification Search

CPC . B65D 9/12; B65D 23/08; B65D 7/14; B65D 7/24; B65D 7/26; A47G 23/02; A47G 23/0216; A47G 2023/0291

USPC ..... 220/4.28, 6, 9.1, 9.2, 9.4, 694

See application file for complete search history.

(56) References Cited

U.S. PATENT DOCUMENTS

| | | | | | |
|---|---|---|---|---|---|
| 955,027 | A * | 4/1910 | Weigand | B65D 7/26 | 220/9.4 |
| 1,115,706 | A * | 11/1914 | Manuel | B65D 9/12 | 220/9.2 |
| 2,664,131 | A * | 12/1953 | Miller | A45C 7/0077 | 383/29 |
| 3,014,516 | A * | 12/1961 | Mueller | B65D 37/00 | 138/131 |
| 3,868,155 | A * | 2/1975 | Cherubini | A47G 5/00 | 135/132 |
| 4,823,972 | A * | 4/1989 | Ressler | A63H 33/00 | 220/4.28 |
| 7,854,688 | B2 * | 12/2010 | Zheng | A63B 9/00 | 190/107 |

* cited by examiner

*Primary Examiner* — John K Fristoe, Jr.
*Assistant Examiner* — Elizabeth J Volz
(74) *Attorney, Agent, or Firm* — Donald R. Boys; Central Coast Patent Agency, LLC

(57) ABSTRACT

A foldable beverage shade is made from a fabric sheet having a bottom edge, side edges and a curved top edge, a first and a second spreader element, and a circular coaster element with a thickness less than one-half inch, a diameter greater than two inches but less than six inches, and a cylindrical outer surface. The spreader elements may be rotated and engaged in pockets to spread the fabric sheet into a shade.

10 Claims, 7 Drawing Sheets

BEVERAGE SHADE

BACKGROUND OF THE INVENTION

1. Field of the Invention

The present invention is in the technical area of apparatus associated with dining and drinking and pertains more particularly to shades adapted for shading a beverage in a container from sunlight of other source of radiating heat. May also be used for parties, camping beach outings, boating and in some sports.

2. Description of Related Art

Shades for shading beverages from sunlight are well-known in the art, and several have been patented. To the inventor's knowledge, however, there are no shades in the art that may be stacked for customers or may be folded to fit in a purse or pocket, and the inventor believes such a shade is needed.

BRIEF SUMMARY OF THE INVENTION

In one embodiment of the invention a foldable beverage shade is provided, comprising a fabric sheet having a bottom edge, side edges and a curved top edge, with an overall height from the bottom edge to a center of the curved top edge, the fabric sheet symmetrical about a center line, a first and a second spreader element, each made from a elongate rod with a cross-section diameter equal to or less than one quarter inch, the spreader elements shaped to have a circular arc length greater than 180 degrees but less than 360 degrees, and a circular coaster element with a thickness less than one-half inch, a diameter greater than two inches but less than six inches, and a cylindrical outer surface. The first spreader element is engaged through a loop joined on the fabric sheet spanning the centerline at a height equal to or less than one half the overall height, and the second spreader element is engaged through a loop joined on the fabric sheet spanning the centerline at a height proximate the uppermost point of each of the two side edges, and characterized that a user is enabled to join the bottom edge of the fabric sheet around the cylindrical outer surface of the coaster element with attachment interfaces provided on the coaster and the fabric sheet, and to raise the first and second spreader elements and engage ends of each into pockets joined on the fabric sheet at edges of the fabric sheet at the height of the loops, such that the fabric sheet forms an erect shade above and around the coaster element, such that a beverage container may be placed on the coaster element and be shaded.

In one embodiment the fabric sheet has pre-pressed fold lines both vertically and horizontally, such that the erect shade may be dismantled to be carried or stored by disengaging the fabric sheet from the coaster element, disengaging the spreader elements from the pockets allowing the fabric sheet to be laid flat, folding the spreader elements to lie on the fabric sheet, and folding the fabric sheet along the fold lines with the spreader elements within the folded sheet. Also, in one embodiment folded sheet has four sides with edges equal to or less than a diameter of the spreader elements. In one embodiment one erect beverage shade fits into another such that a plurality of erect beverage shades may be staked for storage. And in one embodiment the beverage shade further comprises a third spreader element engaged in a loop and pockets at a height proximate the top of the coaster element in the erect beverage shade.

In one embodiment of the invention the spreader elements are made from metal wire and are no more than one-sixteenth inch in cross section diameter. Also, in one embodiment the spreader elements are made from molded plastic and are no more than one-sixteenth inch in cross section diameter. Also, in one embodiment the fabric sheet is stiff material, capable of supporting itself in an upright orientation. In one embodiment the loops and pockets are fabric elements sewn to the fabric sheet. And in one embodiment the loops and pockets are metal or plastic elements joined to the fabric sheet.

In another aspect of the invention a method for forming an erect, foldable beverage shade is provided, comprising joining a bottom edge of a fabric sheet a having a bottom edge, side edges and a curved top edge, with an overall height from the bottom edge to a center of the curved top edge, the fabric sheet symmetrical about a center line, around a cylindrical outer surface of a coaster element having a top and a bottom surface using attachment interfaces provided on the coaster element and the fabric sheet, and raising spreader elements each made from a elongate rod with a cross-section diameter equal to or less than one quarter inch, the spreader elements shaped to have a circular arc length greater than 180 degrees but less than 360 degrees, the spreader elements engaged in loops spanning the centerline of the fabric sheet, to be horizontal, and engaging ends of the spreader elements in pockets joined to the fabric sheet along the side edges of the fabric sheet, such that the spreader elements, such that the fabric sheet forms an erect shade above and around the coaster element, and a beverage container may be placed on the coaster element and be shaded.

In one embodiment of the method the fabric sheet has pre-pressed fold lines both vertically and horizontally, comprising steps for dismantling the erect shade to be carried or stored, by disengaging the fabric sheet from the coaster element, disengaging the spreader elements from the pockets allowing the fabric sheet to be laid flat, folding the spreader elements to lie on the fabric sheet, and folding the fabric sheet along the fold lines with the spreader elements within the folded sheet. Also, in one embodiment the folded sheet has four sides with edges equal to or less than a diameter of the spreader elements, comprising a step for folding the coaster element within the folded plastic sheet, and placing the folded assembly into a pocket or a purse. In one embodiment one erect beverage shade fits into another, comprising steps for stacking a plurality of erect beverage shades for storage. And in one embodiment the method further comprises a third spreader element engaged in a loop and pockets at a height proximate the top of the coaster element in the erect beverage shade, comprising steps for erecting the beverage shade with three spreader elements.

In one embodiment of the method the spreader elements are made from metal wire and are no more than one-sixteenth inch in cross section diameter, comprising steps for erecting a beverage shade with the wire spreader elements. Also, in one embodiment the spreader elements are made from molded plastic and are no more than one-sixteenth inch in cross section diameter, comprising steps for erecting a beverage shade with the plastic spreader elements. In one embodiment the fabric sheet is stiff material, capable of supporting itself in an upright orientation, comprising steps for erecting the beverage shade with the still material fabric sheet. In one embodiment the loops and pockets are fabric elements sewn to the fabric sheet, comprising steps for erecting the beverage shade with the fabric loops and pockets. And in one embodiment the loops and pockets are metal or plastic elements joined to the fabric sheet, comprising steps for erecting the beverage shade with the metal or plastic lops and pockets.

DETAILED DESCRIPTION OF THE INVENTION

Figure 1:
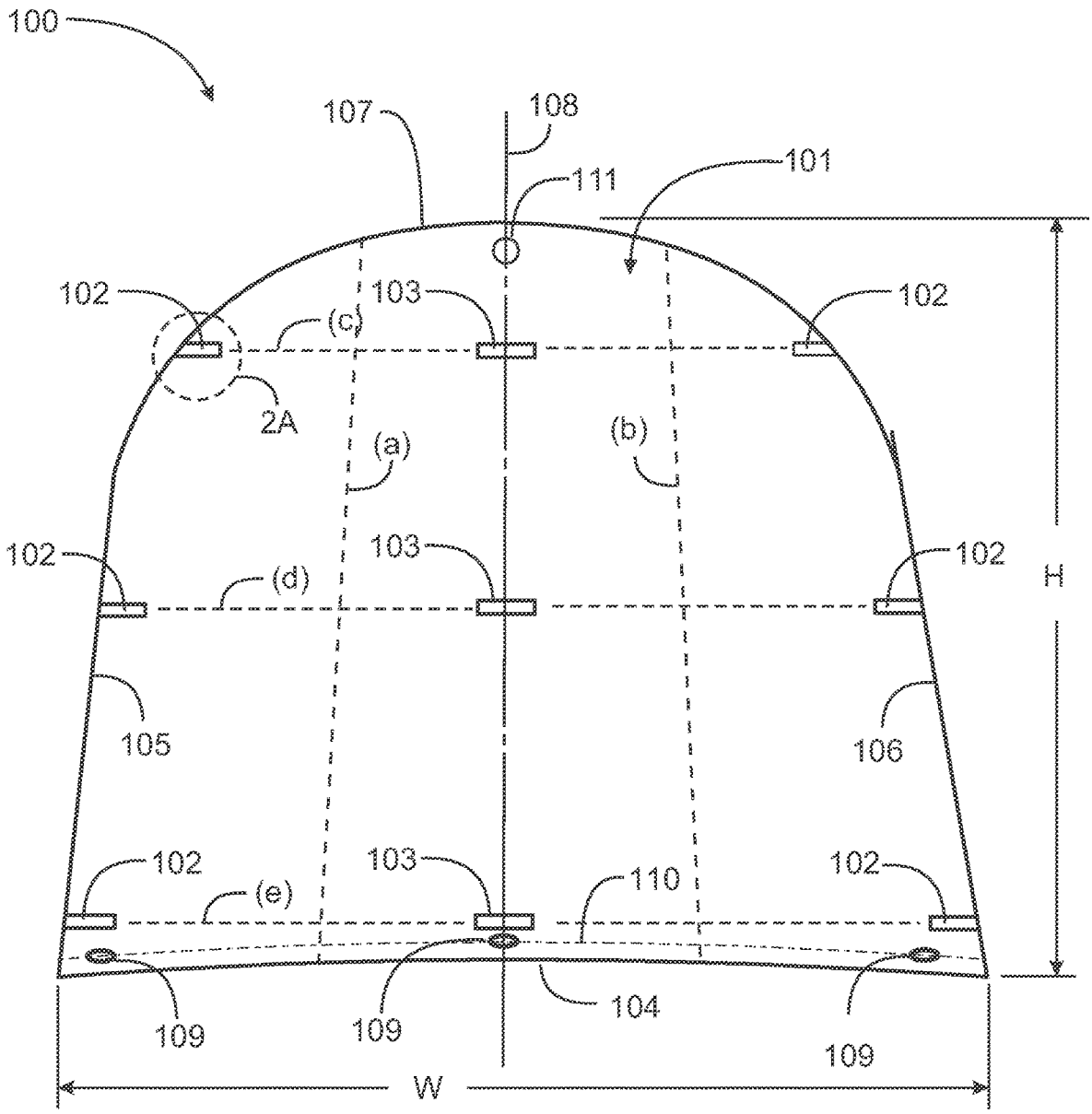
FIG. 1 is a plan view of a fabric body structure for a beverage shade according to an embodiment of the invention.

FIG. 1 is a plan view of a body structure 100 for a beverage shade according to an embodiment of the invention. Body structure 100 comprises a shaped portion 101 of a substantially stiff fabric, such as plastic, felt or canvas. The nature of the fabric is such that a portion may support itself upright on a surface but may also be folded. Portion 101 has a bottom width W and an overall height H with curved bottom edge 104, straight angled opposite sides 105 and 106 and a curved top 107. Dotted lines (a), (b), (c), (d) and (e) represent fold lines which are further explained below. In this example three oval-shaped openings 109 are implemented along curved bottom edge 104, one each near left and right sides 105 and 106 and the third centered on centerline 108. In a preferred embodiment these openings are reinforced in the edges, such as by stitching like a buttonhole. The openings are arranged along a curved line 110 with the same curvature as bottom edge 104.

Portion 101 in this example is symmetrical about a vertical centerline 108. Six pockets 102 are created along edges of the fabric portion as shown, and three loops 103 are created across the centerline at three different heights.

In one embodiment a fastener 111 is implemented at about the position shown in FIG. 1 and a matching fastener is implemented on another part of the fabric, such that in folding a portion may be folded over and fastened to hold the folded unit in place. The folding is shown and described below with reference to FIG. 6A.

Figure 2A:
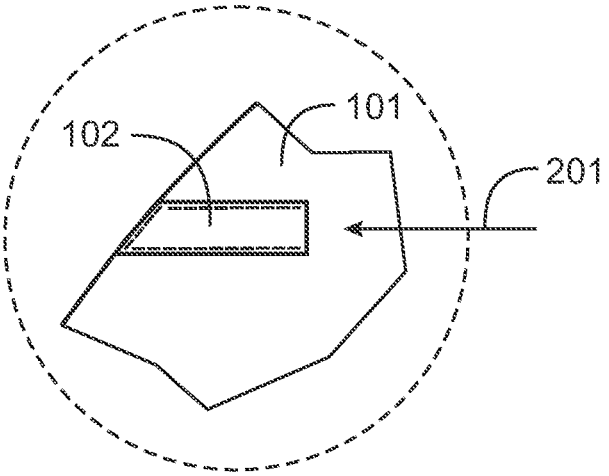
FIG. 2A illustrates a plan view of a pocket on the body structure of FIG. 1.

Detail 2A shown as a dotted circle in FIG. 1 is produced as FIG. 2A to better describe pockets 102. Referring now to FIG. 2A, one of six pockets 102 is shown in plan view along an edge of fabric portion 101. Dotted lines along edges of pocket 102 represent stitching of fabric of the pocket to fabric portion 101. The stitching is along three sides as shown and one end toward the center is open, hence a pocket. Stitching is one option for securing pockets 102 to fabric portion 101, as the pockets may in other embodiments be applied with adhesive. In some embodiments pockets may be provided as metal or plastic elements that may be anchored to the fabric of portion 101 in a variety of ways.

Figure 2B:
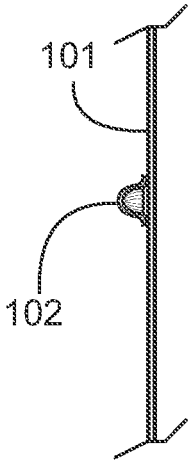
FIG. 2B is an end view of the pocket of FIG. 2A.

Arrow 201 in FIG. 2A represents a view direction for FIG. 2B. Viewing along the direction of arrow 201 one sees fabric portion 101 on edge and sees pocket 102 from the open end. The skilled person will understand that the other five pockets 102 are formed like the pocket 102 shown in FIGS. 2A and 2B, providing six pockets all along edges of the fabric portion as shown.

Figure 2C:
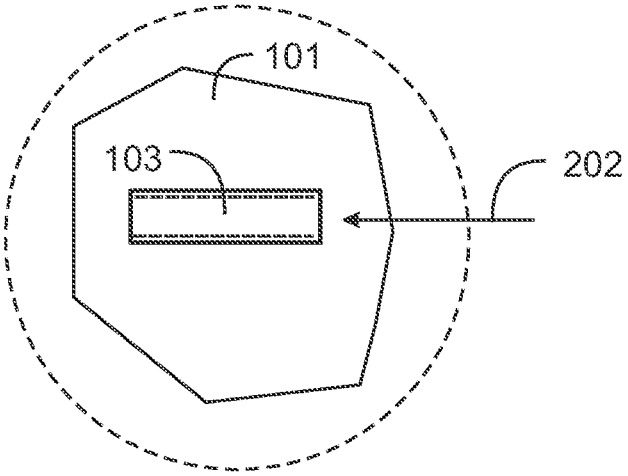
FIG. 2C is a plan view of a loop on the body structure of FIG. 1.
Figure 2D:
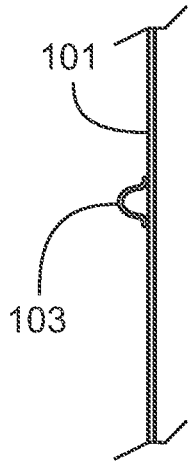
FIG. 2D is an end view of the loop of FIG. 2C.

FIG. 2C illustrates one of three loops 103 formed on the surface of fabric portion 101 as shown in FIG. 1. Arrow 202 is a viewing direction for FIG. 2D, which views loop 103 from one open end and out the opposite open end, as loop 103 is stitched only at top and bottom edges, and ends are open. As described for pockets 102, loops 103 may be metal or plastic elements in other embodiments and may be fastened to the fabric of portion 101 in a variety of ways.

In alternative embodiments pockets 102 and loops 103 may be implemented as rigid elements fastened to the surface of fabric portion 101. These rigid elements may be, for example, metal tubes, open both ends for loops 103 and closed one end for pockets 102. The tubes need not be metal, but could also be plastic, for example. There are alternative ways that the pockets and loops may be implemented.

Figure 3A:
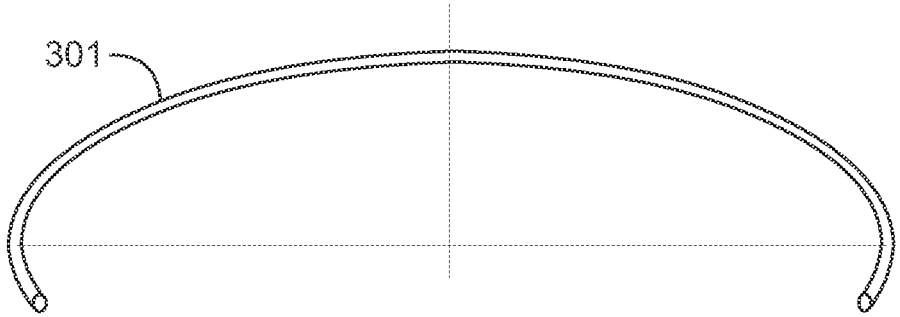
FIG. 3A is a perspective view of a spreader in an embodiment of the invention.
Figure 3B:
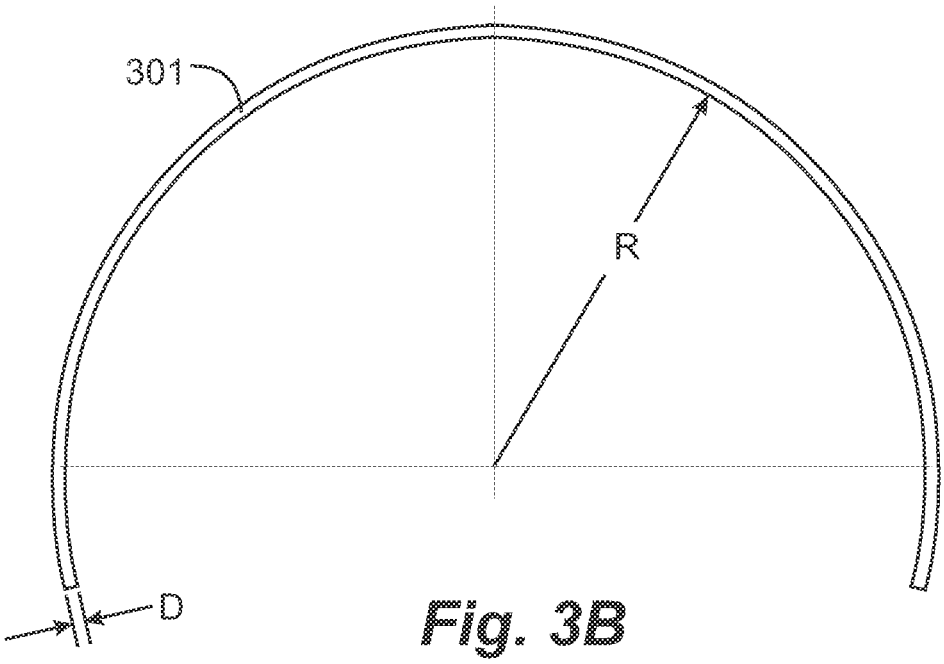
FIG. 3B is a plan view of the spreader of FIG. 3A.

FIG. 3A is a perspective view of a spreader element 301 for use with the body structure 100 of FIG. 1 to implement a beverage shade. Spreader 301 is a wire formed in a circular arc in one embodiment, but may be plastic or other material in other embodiments. The arc length in this example for the spreader is somewhat greater than 180 degrees. In one embodiment the arc length is 200 degrees. Diameter D of the spreader element is of a dimension that the wire may pass through loops 103 and ends of the spreader wire may engage pockets 102. The radius of spreader 301 is labeled R. In implementing a beverage shade three spreaders 301 are used, and each may be of a somewhat different Radius R.

Figure 4A:
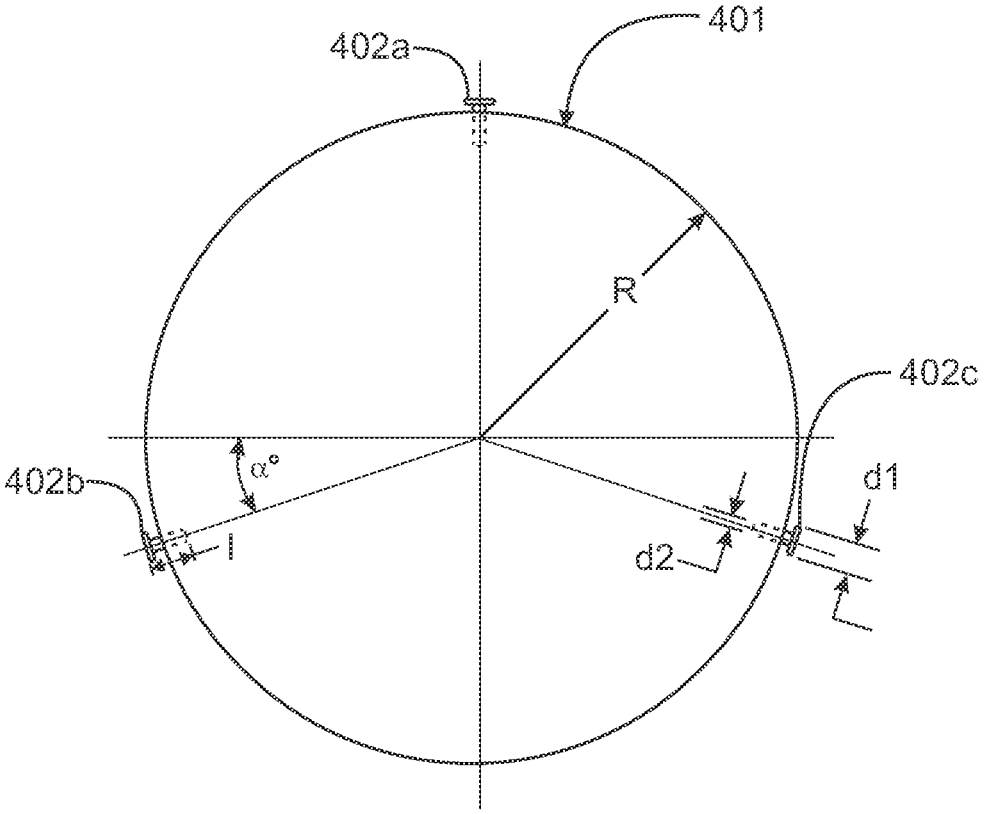
FIG. 4A is a plan view of a coaster in an embodiment of the invention.
Figure 4B:
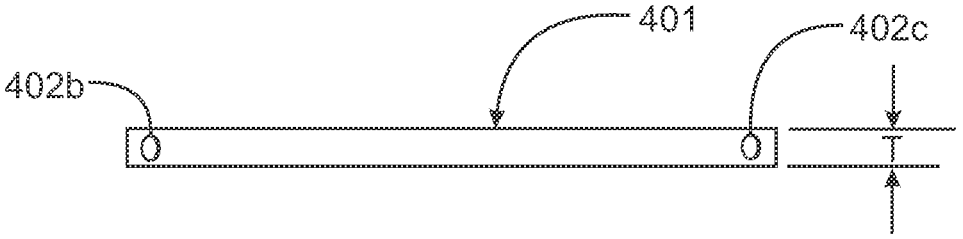
FIG. 4B is a side elevation view of the coaster of FIG. 4A.

FIG. 4A is a plan view of a coaster 401 as a part of a beverage shade in an embodiment of the invention. FIG. 4B is a side elevation view of coaster 401. The thickness T of the coaster is in this example about ¼ inch but may be somewhat different in other embodiments. A purpose of the coaster is to support a beverage container, such as a cup or a bottle in an embodiment of the invention. In some embodiments coaster 401 may be molded plastic, but may be made of any other suitable material, such as various forms of wood. In some embodiments a metal weight may be incorporated to provide stability for a beverage shade including the coaster.

Coaster 401 in this example has three button retainers 402*a*, 402*b* and 402*c* engaged to the outside rim of the coaster, such as by screw thread or by pressing into a bore in the coaster. Each button retainer has a head diameter d1, a shaft diameter d2 and a length l, the shaft diameter being substantially smaller than the head diameter. The radial spacing between button retainer 402*a* and 402*b*, and also between 402*a* and 402*c*, in this example is about one hundred degrees. The overall radial extent from button 402*b* through button 402*a* to button 402*c* is therefore about 200 degrees, somewhat more than ½ of a circular arc. An important purpose of the button retainers is to engage openings 109 along the bottom edge of fabric portion 101, to assemble the fabric portion to the coaster. This assembly and integration is described in enabling detail below.

Figure 5:
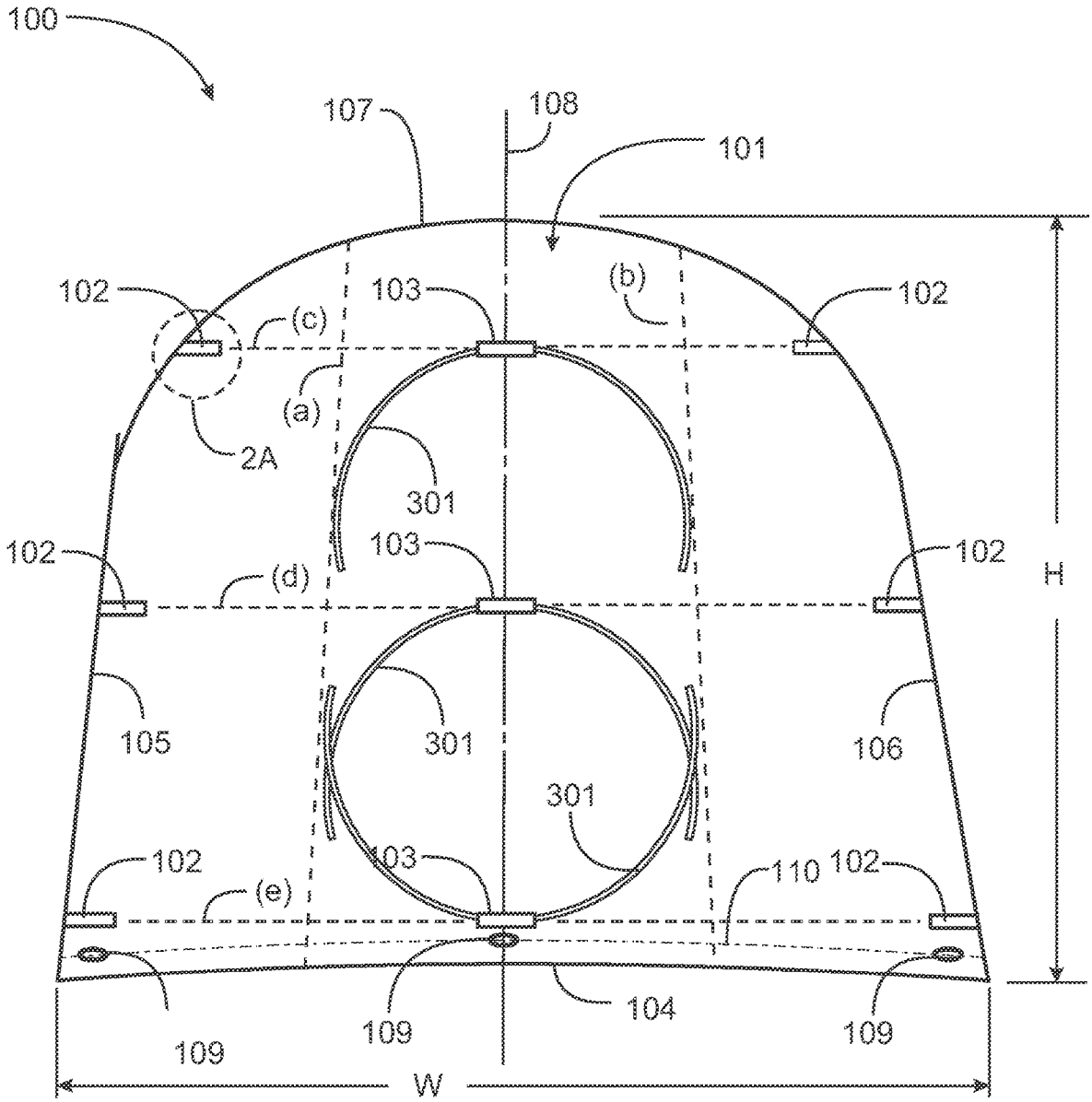
FIG. 5 is a plan view of the body structure of FIG. 1 with spreaders assemble to loops.

FIG. 5 is a plan view of fabric portion 101 with the three spreaders 301 engaged through loops 103. In assembly one may just place one end of the spreader into the loop and slide it through until evenly engaged as shown. The spreader in the top loop is folded down to lie flat on the fabric. The spreader in the middle loop is also folded down. The spreader through the bottom loop is folded up against the fabric. In this example, with the angled sides such that the width of the fabric portion is greater at a lower position, the spreaders may be of different diameters to suit.

Referring again to FIG. 5, with three spreaders engaged, attention is drawn to fold lines (a), (b), (c), (d) and (e). In one embodiment the fabric portion 101 may be folded by first folding the part below fold line (d) upward along fold line (d), then the portion above fold line (c) downward along line (c). The portion to the left of fold line (a) is then folded to the right around fold line (a). Next, the portion to the right of fold line (b) is folded to the left around fold line (b). Finally, the folded portion above fold line (c) is folded down over the folded portion bounded by fold lines (a), (b), (c) and (d). The result of this folding sequence is a folded unit 601 as shown in FIG. 6A with the spreaders, still engaged in the loops, folded within the layers of fabric.

In one example, referring again to FIG. 5, a user may:

1. Fold over center right
2. Fold over center left, and
3. Fold up to c with fold at d line.

Figures 6A, 6B:
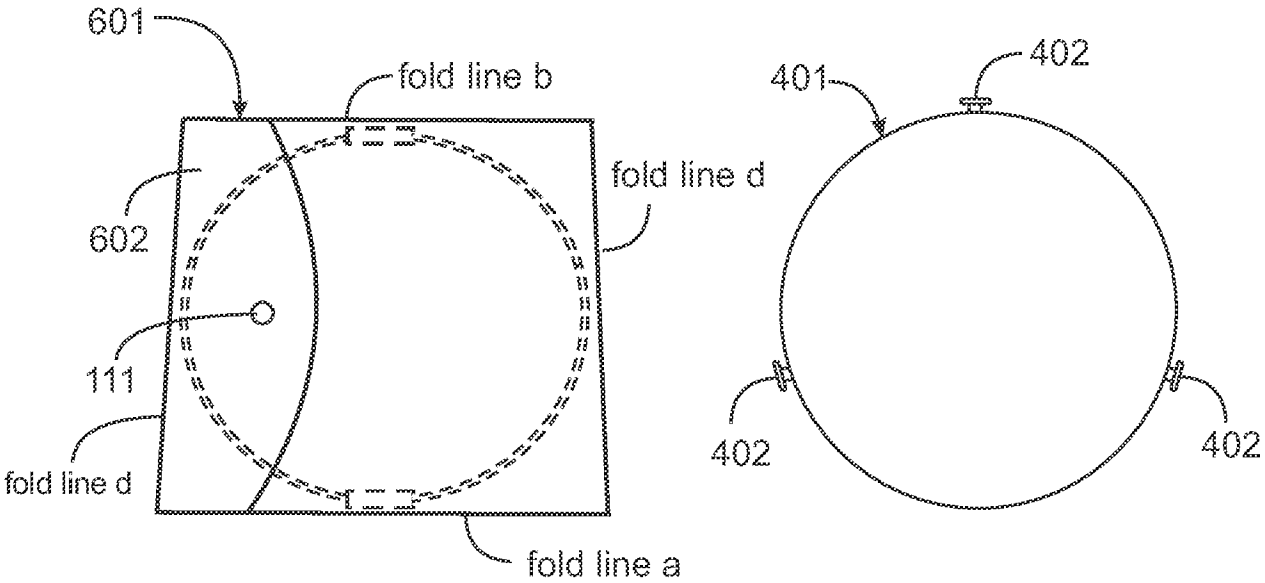
FIG. 6A is a plan view of the body structure of FIG. 5 folded.
FIG. 6B is a plan view of the coaster.

FIG. 6A also shows a flap formed by folding down around line c, which is a part of the fabric portion as seen in FIG. 1, in which a fastener 111 is implemented. The final folded unit may be secured with the fastener.

Folded unit 601 is of a size that may be easily carried in a pocket or a purse. In one embodiment the folded unit may be a four-by-four inch approximate square. Coaster 401 is shown in FIG. 6B alongside the folded packet 601 and is of a diameter that the coaster may be easily carried with the folded unit in a pocket or a purse.

Figure 7:
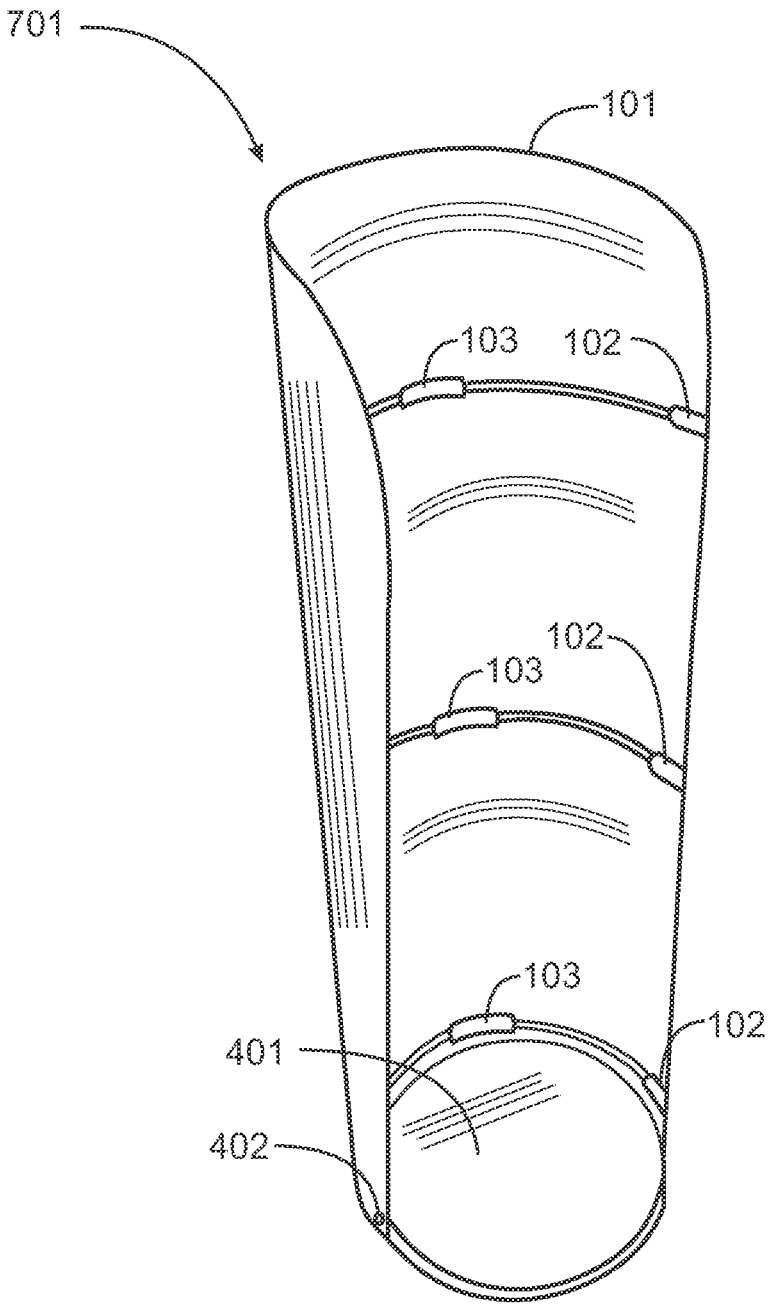
FIG. 7 is a perspective view of a beverage shade fully assembled in an embodiment of the invention.

FIG. 7 is a perspective view of an assembled beverage shade 701 comprising the fabric portion 101, the three spreaders 301 and the coaster 401. Beginning with the folded unit 601 shown in FIG. 6A a user unfolds the folded unit to be flat as shown in FIG. 5. The user then rotates the spreaders 301 to be all three perpendicular to the fabric portion and inserts the opposite ends of each spreader into the pockets 102 at opposite edges of the fabric unit. This operation provides the shape shown in FIG. 7, wherein the lower edge of the fabric unit 101 is wrapped around the coaster through an arc somewhat greater than 180 degrees, in this example where alpha in FIG. 4 is 10 degrees, the wraparound arc length is 200 degrees. As a last step the user engages each of three button retainers 402 through the three buttonhole openings 109 along the bottom skirt of the fabric portion 101. This operation engages the coaster 401 to the fabric portion and completes the assembly.

It is to be understood that in this assembly the curved bottom edge 104, and the placement of openings 109 also along the curve of the bottom edge of the fabric portion results in the back edge of the erect fabric portion 101, which may be referenced by centerline 108 in FIG. 1, to lean outward away from coaster 401. This result mimics the cross-sectional shape of a paper cup for example.

An important result of the shape of the erect fabric portion and the fact of the engagement to the coaster around more than 180 degrees, enables a user to stack assembled shades in embodiments of this invention withing one another, as one might stack a plurality of paper cups.

Assembled shades according to embodiments of the present invention may be used to shade a beverage container placed on the coaster. When not needed the assembled shade may be disassembled and stored or carried in a purse or a pocket.

A skilled person will understand that the examples and embodiments described herein are entirely exemplary and place no restriction on the scope of the invention. There are many options in the various embodiments, such as dimensions and materials. In one important variation the fabric shade may be made with the buttons on the coaster spanning 180 degrees or less, and the bottom edge 104 of portion 101 may either be curved or not curved, and the resulting assembly will still be useful as a shade, and may be foldable, but may not be as stackable as the embodiment first described above.

In another alternative embodiment the lowermost pockets 102 and loop 103 that, in the assembled shade, are just above the top surface of the coaster, may be eliminated along with the associated spreader element 301. In this alternative embodiment there are two loops and four pockets instead of three loops and six pockets. Other variations are also possible within the scope of the invention, which is limited only by the claims.

The invention claimed is:

1. A foldable beverage shade, comprising:

a fabric sheet having a bottom edge, side edges and a curved top edge, with an overall height from the bottom edge to a center of the curved top edge, the fabric sheet symmetrical about a center line;

a first and a second spreader element, each made from a elongate rod with a cross-section diameter equal to or less than one quarter inch, the spreader elements shaped to have a circular arc length greater than 180 degrees but less than 360 degrees; and a circular coaster element with a thickness less than one-half inch, a diameter greater than two inches but less than six inches, and a cylindrical outer surface;

characterized in that the first spreader element is engaged through a loop joined on the fabric sheet spanning the centerline at a height equal to or less than one half the overall height, and the second spreader element is engaged through a loop joined on the fabric sheet spanning the centerline at a height proximate the uppermost point of each of the two side edges, and characterized that a user is enabled to join the bottom edge of the fabric sheet around the cylindrical outer surface of the coaster element with attachment interfaces provided on the coaster and the fabric sheet, and to raise the first and second spreader elements and engage ends of each into pockets joined on the fabric sheet at edges of the fabric sheet at the height of the loops, such that the fabric sheet forms an erect shade above and around the coaster element, such that a beverage container may be placed on the coaster element and be shaded.

2. The foldable beverage shade of claim 1 wherein the fabric sheet has pre-pressed fold lines both vertically and horizontally, such that the erect shade may be dismantled to be carried or stored by disengaging the fabric sheet from the coaster element, disengaging the spreader elements from the pockets allowing the fabric sheet to be laid flat, folding the spreader elements to lie on the fabric sheet, and folding the fabric sheet along the fold lines with the spreader elements within the folded sheet.

3. The foldable beverage shade of claim 2 wherein the folded sheet has four sides with edges equal to or less than a diameter of the spreader elements.

4. The foldable beverage shade of claim 1 wherein one erect beverage shade fits into another such that a plurality of erect beverage shades may be staked for storage.

5. The foldable beverage shade of claim 1 further comprising a third spreader element engaged in a loop and pockets at a height proximate the top of the coaster element in the erect beverage shade.

6. The foldable beverage shade of claim 1 wherein the spreader elements are made from metal wire and are no more than one-sixteenth inch in cross section diameter.

7. The foldable beverage shade of claim 1 wherein the spreader elements are made from molded plastic and are no more than one-sixteenth inch in cross section diameter.

8. The foldable beverage shade of claim 1 wherein the fabric sheet is stiff material, capable of supporting itself in an upright orientation.

9. The foldable beverage shade of claim 1 wherein the loops and pockets are fabric elements sewn to the fabric sheet.

10. The foldable beverage shade of claim 1 wherein the loops and pockets are metal or plastic elements joined to the fabric sheet.

* * * * *